US010077539B1

(12) United States Patent
Hunt

(10) Patent No.: US 10,077,539 B1
(45) Date of Patent: Sep. 18, 2018

(54) WALL AND RETAINING MEMBERS AND FLUIDIZING INSTALLATION OF RETAINING MEMBERS

(71) Applicant: Southern Jetwall LLC, Fruitland Park, FL (US)

(72) Inventor: Lloyd Hunt, Hialeah, FL (US)

(73) Assignee: Southern Jetwall LLC, Fruitland Park, FL (US)

( * ) Notice: Subject to any disclaimer, the term of this patent is extended or adjusted under 35 U.S.C. 154(b) by 0 days.

(21) Appl. No.: 15/493,771

(22) Filed: Apr. 21, 2017

Related U.S. Application Data

(63) Continuation of application No. 15/142,451, filed on Apr. 29, 2016.

(60) Provisional application No. 62/155,554, filed on May 1, 2015.

(51) Int. Cl.
*E02D 7/24* (2006.01)
*E02D 5/32* (2006.01)

(52) U.S. Cl.
CPC ..... *E02D 7/24* (2013.01); *E02D 5/32* (2013.01)

(58) Field of Classification Search
CPC ..... E02D 7/24; E02D 5/32
See application file for complete search history.

(56) References Cited

U.S. PATENT DOCUMENTS

| | | | | |
|---|---|---|---|---|
| 5,428,926 | A * | 7/1995 | Melfi | E01F 8/0017 52/247 |
| 5,689,927 | A * | 11/1997 | Knight, Sr. | E01F 8/0023 181/210 |
| 6,231,270 | B1 * | 5/2001 | Cacossa | E02D 5/32 175/424 |
| 7,416,368 | B2 * | 8/2008 | Dagher | E02D 5/02 405/274 |
| 2005/0120644 | A1 * | 6/2005 | Tadros | E04C 3/22 52/155 |
| 2005/0163575 | A1 * | 7/2005 | Dagher | E02D 5/02 405/274 |
| 2010/0054859 | A1 * | 3/2010 | He | E02D 5/14 405/36 |
| 2010/0232888 | A1 * | 9/2010 | Kreis | E02D 7/24 405/248 |

* cited by examiner

*Primary Examiner* — Andrew J Triggs
(74) *Attorney, Agent, or Firm* — Christopher Paradies; Paradies Law P.A.

(57) ABSTRACT

A pair of retaining members each comprise a paddle-shaped end portion and a retaining portion between which a wall panel is retained. The panel-shaped end portion has at least one channel and exit ports through which a fluid is capable of being injected in order to fluidize the soil beneath the retaining members, causing the panel-shaped end portion to sink into the soil and consolidating the soil surrounding the panel-shaped end portion. The shape and soil consolidation work to fix the panel in position, sometimes without the need for soil grouting or other soil consolidation processes that would be required, otherwise.

20 Claims, 4 Drawing Sheets

Fig. 1
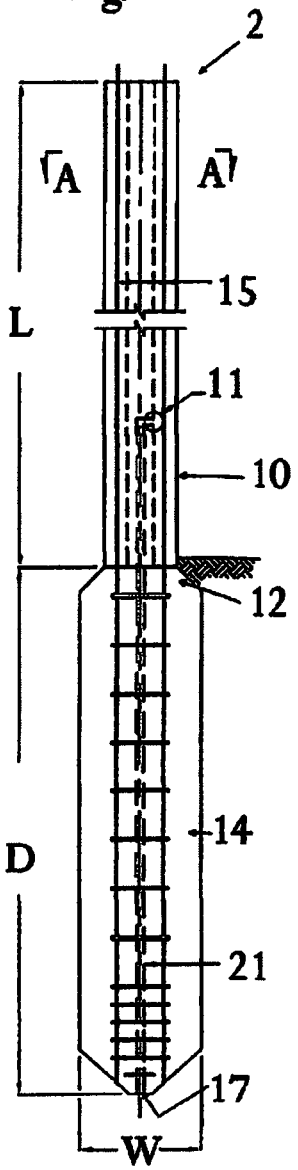
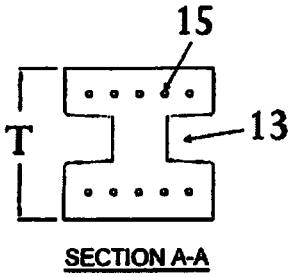
Fig. 3
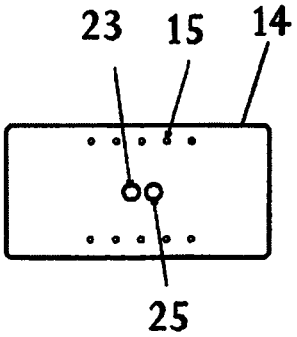
Fig. 4
Fig. 2
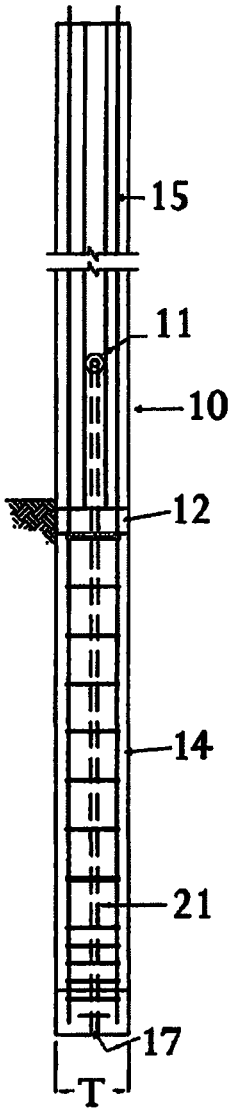

WALL AND RETAINING MEMBERS AND FLUIDIZING INSTALLATION OF RETAINING MEMBERS

CROSS RELATED APPLICATIONS

This application is a continuation of U.S. non-provisional application Ser. No. 15/142,451 filed Apr. 29, 2016 which claims priority to U.S. Prov. Appl. 62/155,554, entitled Wall And Retaining Members And Fluidizing Installation Of Retaining Members, which was filed May 1, 2015 and the disclosures and drawings of which are incorporated by reference in their entirety.

FIELD OF THE INVENTION

The field relates to installation of walls and sound barriers.

BACKGROUND

It is known to use walls to reduce hazards and noise from busy highways and other roadways. Precast panels may be used as walls and may be lowered into slots formed in H-shaped posts. The H-shaped posts may be attached to footings, mechanically, or may be inserted into holes in the ground that are filled with grout. If the latter, then the posts must be held in position by a jig to ensure that the posts are vertical, aligned with each other and spaced correctly to accommodate the wall panel. This requires careful setup, extra steps, extra time for setting up the grout before removing the jig and a volume of grout that fills the hole, when the hole is drilled, without the post even being inserted, yet, all of which is time consuming and wasteful of materials.

U.S. Pub. No. 2005/0120644 discloses a precast, post-tensioned segmental pole, which does nothing to solve the problems of time consuming installation and wasteful use of grout.

U.S. Pub. No. 2005/0252124 discloses a post anchoring device that anchors a post to a foundation surface, such as a slab or footing, such as a cast in place slab or foundation.

U.S. Pat. No. 5,689,927 discloses poured concrete footings with closed loop reinforcing rods arrayed around a depression in which sound barrier posts are inserted and grouted using fast setting grout. While this reduces the time for installing the posts, after the footings are poured, it does nothing to reduce the wasteful use of concrete in the poured footing. Also, the overall time is still quite long, because the footings must be precisely poured and must be allowed to set before the posts are grouted into the depressions surrounded by closed loop reinforcements. The drawings of FIGS. 3 and 4 provide an example of noise walls inserted in H-shaped posts extending above the surface of the ground.

U.S. Pat. No. 5,806,262 discloses a partial poured footing that is mechanically fastened to the bottom of a post before the remainder of a footing is poured. This reduces the time to install the posts and gives some flexibility in plumbing the posts before pouring the remaining portion of the footing, but it requires additional steps and more time for the setting up of the partial footing and then the remaining footing.

U.S. Pat. No. 4,887,691 discloses a post-tensioning cable system used in a post mounted in poured footing. After attaching the post by the post-tensioning cable system, grout is poured to fill voids. Again, this adds steps and requires time for both the footing to set up and for the grout in the voids to set up. While this adds a tensioning cable, it does not solve the wasteful use of materials or the wasted time setting the concrete footing and setting the post in grout. FIGS. 1-3 illustrate another example of an H-shaped post and wall panel system.

U.S. Pat. No. 4,605,090 illustrates another example of an H-shaped post and noise barrier panel system that is capable of following contours in the terrain.

U.S. Pat. No. 3,617,028 illustrates yet another example of H-shaped posts and panels, which may be decorative in this example.

In all of the examples, the steps required to position and anchor the posts result in extra labor, materials and time in order to install wall panels retained by the retaining posts. The need to precisely space the posts and to accurately plumb the posts makes pouring and setting up footings tricky.

SUMMARY

A wall is comprised of a panel retained in place by a pair of retaining members. The pair of retaining members are disposed on opposite sides of the wall such that one of the pair of retaining members engages at least a portion of one of the opposite sides of the wall and the other of the pair of retaining members engages the other of the opposite sides of the wall. The retaining members are pre-stressed concrete or post-tensioned reinforcing members in a cementitious material, such as a concrete, for example, providing superior resistance to cracking and improved load bearing capacity. In one example, the retaining member comprises at least one channel extending from an inlet port at a portion of the retaining member intended to remain above ground and an exit port at an end of the retaining member intended to be inserted into the ground, such that a fluid may be injected at a pressure and a flow rate.

For example, the pair of retaining members are not installed by grouting a hole and setting the retaining members in the grout. Instead, the pair of retaining members are installed by fluidizing the soil below the retaining members using a fluid, such as water and/or air, at a pressure and a volume sufficient to reduce the bearing capacity of the soil such that the retaining member penetrates into the soil under its own weight and/or due to a force applied to the retaining member. In one example, the fluidized soil is compacted following fluidization of the soil and insertion of the retaining member into the soil, such that the soil firmly supports the end of the retaining member inserted into the soil, without drilling a hole and grouting the retaining member in the hole. In one example, a drill or other mechanism is used to pre-condition the soil and any roots or other obstructions passing through the soil. However, the soil is retaining in the pre-conditioned column of soil. In this example, the retaining member penetrates into the ground by fluidizing the soil, following pre-conditioning. Again, the fluidization compacts the soil, such that the soil supports the retaining member in the ground without grouting.

The end of the retaining member that is inserted into the ground may be shaped differently from the end extending above ground. For example, the end inserted into the ground may be wider in a direction extending along the line of the wall and thinner in a direction transverse to the direction extending along the line of the wall.

In one example, the retaining member may be made of a separate post and pile. The pile may be jetted into the ground, and the post may be coupled to the pile, later. For example, this may be used under overhead power lines.

In one example, a rocky soil is predrilled with an auger, water jet drilling, with or without an abrasive, a rock drill or hydraulic drilling, some or all of the rock is removed, forming a hole, and a suitable fill is inserted into the hole, prior to the steps of fluidizing the soil and lowering the pile to depth through the fluidized soil. For example, a sand, such as a wet sand, may be used to back fill the hole. Alternatively, if necessary, a grout or other cementitious fill material may be used to fill such a hole for some posts, while other posts are inserted into other soil types, without using cementitious materials in pre-drilled holes.

BRIEF DESCRIPTION OF THE DRAWINGS

The following drawings are illustrative examples and do not further limit any claims that may eventually issue.

FIG. 1 illustrates a side plan view of a retaining member.

FIG. 2 illustrates a front plan view of the retaining member.

FIG. 3 illustrates a cross-sectional view of a portion of the retaining member intended to be installed above-ground.

FIG. 4 illustrates an alternative example of a cross-sectional view of a pile portion of the retaining member intended to be installed below the surface of the ground.

When the same reference characters are used, these labels refer to similar parts in the examples illustrated in the drawings.

DETAILED DESCRIPTION

Figure 5:
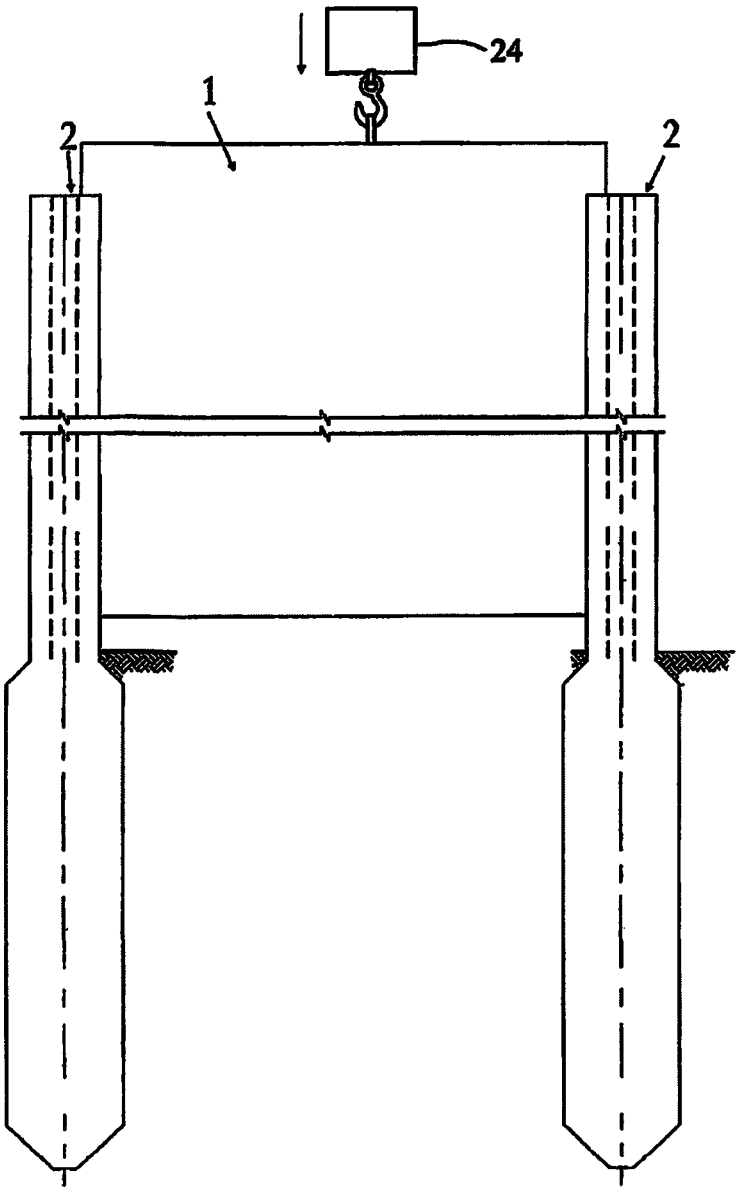
FIG. 5 illustrates a wall retained between a pair of opposite retaining members.

FIGS. 1-5 illustrate examples of a wall and retaining members used to support wall panels. The wall may be a precast concrete panel 1 that is retained within channels 13 formed in the post 10 of the retaining member 2, for example. The post 10 may be integrally formed with the pile 14 and not attached to the pile 14, later. Therefore, the retaining member 2 may be an integrally formed and prestressed or pretensioned concrete member that reduces the chances of crack formation, later, after installation. The design of the retaining member 2, illustrated in the examples of FIGS. 1-5, is capable of withstanding wind shear loads against the wall 1 and the posts 10 extending above ground, without wasted material, because the width W and depth D of the pile 14 is dimensioned for this purpose, while the thickness T of the pile 14 and the post 10 and length L of the post 10 is selected for securely retaining the wall panel 2, separately from the width W of the pile 14. In one example, a width W is 2 feet, 6 inches, while the thickness T is 1 foot, 6 inches, for example.

In the example of FIGS. 1-3, a single PVC duct 21 extends through the pile 14 from an outlet 17 to a jet port 11, disposed above ground. As an alternative, a plurality of PVC ducts 23, 25 may extend through the pile 14 from a plurality of jet ports 11, as illustrated in the alternative example of a cross section of the pile 14, below grade, in FIG. 4. PVC ducts are capable of directing a fluid or fluids down through the pile 14, exiting an outlet 17, and entering into the soil, such that the soil is fluidized. In one example, the fluidized soil allows the pile 14 to settle into the soil under the weight of the retaining member 2, alone. In another example, a pressure and/or vibration is applied to the retaining member 2 during installation of the pile 14 below the ground surface. For example, water, air or a combination of water and air may be injected through one PVC duct 21 or a plurality of PVC ducts 23,25 with sufficient pressure and volume to fluidize the soil. In some cases, an auger drill or the like is used to disturb the soil and cut any roots or other obstruction that are present, below the surface of the ground, prior to jetting in the pile 14. For example, the pressure and volume of fluid may be adjusted until the pile 14 starts to settle into the soil under the weight of the retaining member 2. In the examples shown, the jetting inlet 11 is disposed in the channel 13 used to retain a wall panel 1 in the retaining member 2. In this manner, the jetting inlet 11 is hidden by the wall panel 1, when installed.

An advantage to jetting in the pile 14 is that the surrounding soil becomes compacted, by the jetting process, more than it was prior to being disturbed, allowing the pile 14 to be more securely retained by the soil, even though the soil prior to jetting in would not have been adequate to support the wall 1 and retaining member 2. The soil compaction offers further advantages in time savings and reduced waste of excess materials, because the retaining members 2 may be rapidly jetted in and the wall panels 1 installed by lowering between two adjacent posts 10, without waiting for footings or grouting to set up prior to installation of the wall panels 1. This allows a crew to rapidly construct sections of walls without delays caused by known methods that require setting of concrete footings and/or grouting before the posts can hold their own weight, much less the weight of the wall and wind shear on the wall.

In one example, a rocky substrate is not suitable for jetting in the piles and is predrilled, instead, such as by hydraulic drilling or other drilling capable of penetrating the substrate. Then, the rocky fragments and/or unsuitable materials are removed, and the hole created is back-filled with suitable material for jetting in the piles 14. For example, a soil may be backfilled into the holes, prior to jetting in the piles 14, according to the method already described for sinking the piles into unconsolidated soils. The end result is the same as the results in soils where jetting in can be done directly, where the material added consolidates, and the compaction of the soil readily supports the piles 14, the wall panels 1, and posts 10, and supports these structures against even high wind shears due to severe weather.

In the example illustrated in FIGS. 1-4, the shape of the retaining member 2 is referred to as "paddle-shaped," because the pile width W is greater than the post width, post thickness and pile thickness T, and there is a transition region 12, preferably below grade, that transitions from the post width T to the pile width W. Thus, paddle-shaped refers to this shape, which looks something like a paddle. The transition region of the paddle-shaped retaining member 2 may be quite abrupt or may be more gradual.

Since the post 10 and pile 14 are integrally formed, a plurality of pretensioned strands 15 extending continuously through the post 10 and the pile 14, without discontinuity, provides a prestressed (or pretensioned), precast concrete retaining member 2 that is resistant to cracking. A pile without such pre-tensioned strands is known to crack, and only by cracking will rebar precast into the piles start to take up loads. The pretensioned strands 15, unlike normal rebar, can be pretensioned during the casting of the retaining member 2. When the precast retaining member 2 sets up and the pretensioning rig releases the strands, the strands 15 apply a compressive force (i.e. prestressed or pretensioned) along the entire length of the retaining member 2, reducing the tendency of the retaining member 2 to crack. By preventing cracking, the pretensioned strands 15 can prevent corrosion of the reinforcing strands 15, which further reduces waste of materials. Otherwise, in known walls, iron rebar must be inserted that exceeds the requirements for reinforcement, precisely due to the calculation that the rebar will start to rust when the cement and/or other components of a cementitious material used in the footings and posts starts to crack, early on in the life of the wall. The useful life of the wall is determined by how fast the rebar is expected to rust. In the examples shown in FIGS. 1-4, the ten pretensioned strands 15 apply compression to the entire length of the retaining member, resisting cracking of the cement and preventing corrosion of the strands 15. This extends the useful life of a wall made using the prestressed retaining members 2 and/or reduces the amount of comparatively expensive iron or other materials required to reinforce other known footings and/or posts set into footings for retaining wall panels that are installed for safety and/or sound barriers and the like.

FIG. 5 illustrates an example of a wall panel 1 being lowered between two retaining members 2, previously jetted into the ground, using a crane 24. The crane 24 that is being used to lower the wall panel 1 may be used for lowering the retaining members 2 during jetting in, also. For jetting in the retaining members 2 a pump (not shown) is attached to the port 11 for delivering a sufficient volume of fluid at a sufficient pressure to fluidize the soil under and around the pile, while the crain 24 lowers the pile into the ground. It is an advantage of this example of the method that the crane 24 may be used for lowering both the retaining members 2 and the wall panels 1, without delay. Known methods require time for cement or grout to cure before installing the wall panels 1.

Figure 6:
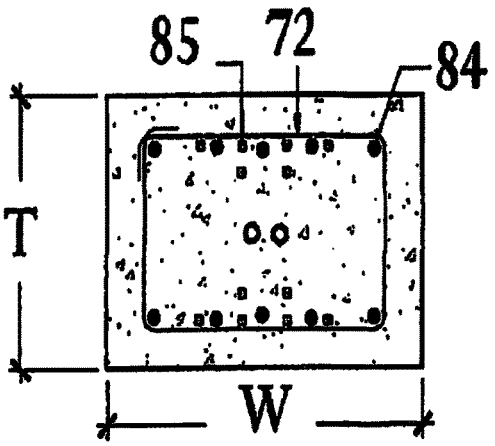
FIG. 6 schematically illustrates one example of a cross section of a pile.
Figure 7:
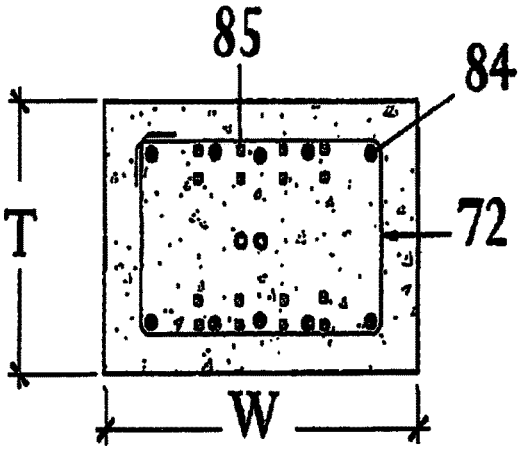
FIG. 7 schematically illustrates another example of a cross section of a pile.
Figure 8:
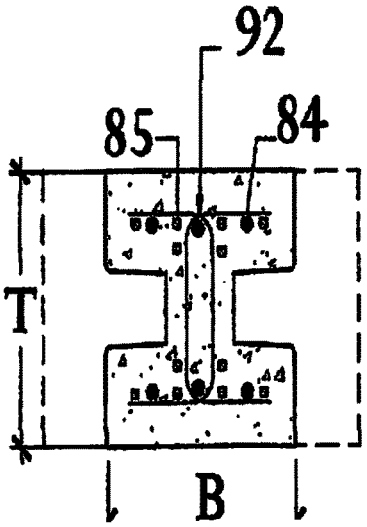
FIG. 8 schematically illustrates an example of a cross section of a post.
Figure 9:
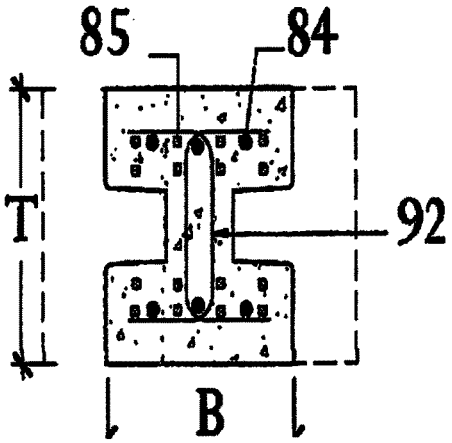
FIG. 9 schematically illustrates another example of a cross section of a post.

FIGS. 6-9 illustrate examples of a cross sections from piles and posts for two alternative examples. FIGS. 6 and 8 are a schematic illustration for the placement of rebar 84 and wire strand 85 within a retaining member having an overall length L+D of thirty-two feet, for example. FIGS. 7 and 9 schematically illustrate the an example of additional wire strand added for an overall length L+D of forty-four feet, for example. In the example of FIGS. 6 and 8, twelve wire strands 85 are disposed within the retaining member, and extend the length of the retaining member. FIG. 6 schematically shows 10 rebar 84 running the length of the pile, while the post, in FIG. 8, only shows 6 of the rebar 84 extending up into the post. The thickness T of the post and pile are the same, such as one foot and eight inches, but the width B of the post is sized independently, such as one foot and six inches. The width W of the pile, such as two feet and six inches, is greater than the width B of the post, allowing a length of pile of sixteen feet to support a post of sixteen feet, for example. Schematically, ties 92 are shown in FIG. 6, such as #4 ties spaced along the length of the pile every twelve inches, which add additional reinforcement to the pile. FIG. 8 schematically illustrates U-bar reinforcement 92, such as #4 U-bar spaced along the length of the post every twelve inches. Alternatively, left and right U-bar reinforcement 92 may be spaced apart by six inches, i.e. with a left U-bar space from a right U-bar every six inches, for example. The only change depicted in FIGS. 7 and 9 are the number and placement of wire strands 85, compared to the example in FIGS. 6 and 8. Specifically, this example illustrates the location of four additional wire strands that run the length of the retaining member 2. For example, wire strands 85 may be comprises of cable, such a high tensile strength steel cable that is stretched (i.e. in tension) during setting of the precast retaining member 2. As a result, when tension is released after curing of a precast, concrete retaining member 2, the retaining member 2 is placed in compression, preventing (or at least reducing) cracking of the casting. For example, the level of compression induced by the wire strands 15, 85 in the examples depends on the tensile load, location and number of the wire strands. The tensile load imposed during casting is limited by the tensile strength of the wire strands. High tensile strength is preferred to reduce the number of strands required to achieve a particular level of compression. Prestressed and poststressed concrete (or other cementitious material) is used in highway bridges and other structures for a variety of reasons, and the calculation of the levels of compression of concrete members is known that will reduce failure of concrete member in a variety of shapes. The level of compression is determined based on a variety of factors including the expected tensile and compressive loads, both static and dynamic, for which a structural member is being designed.

Figure 10:
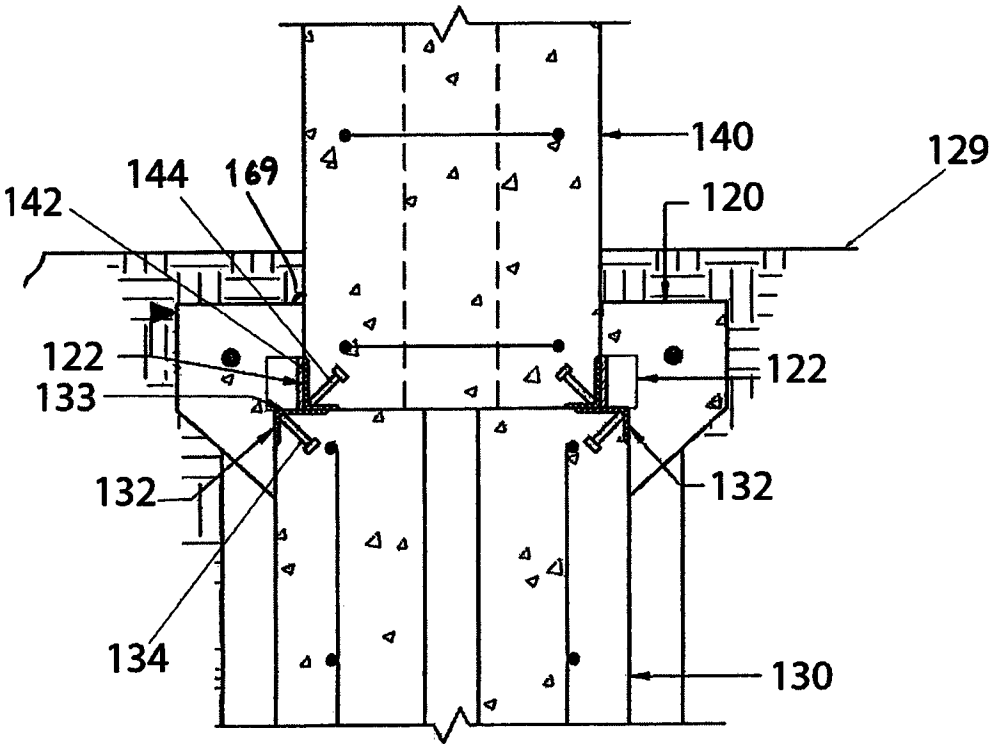
FIG. 10 illustrates another example of a cross section of a pile and separate post joined together after the pile is inserted into the ground.

FIG. 10 illustrates an example of a separate post 140 extending above the ground and a pile 132 jetted into the ground 129. The bottom portion of the post 140 may have a weldable metal edge plate 142 with a stud 144 extending from a inner corner of the metal edge 142 and embedded in the concrete post. A second weldable metal edge plate 132 with a stud 134 embedded in the concrete pile 130. A T-shaped metal support 122 is welded to the first edge plate 142 and the second edge plate 132, joining the post 140 to the pile 130. For example a weldment 132 is made between the support 122 and the second edge plate 132. Then, an optional collar 120 may be sized to provide a stable anchor. The size may be selected to protect the joint between a post and a pile, or a larger size may be selected to function as a structural anchor when poured below grade and buried in surrounding soil. Thus, the collar may be an additional footing that adds to the structural stability of the post and pile. For example, the collar may be cast in place and may be buried below the surface of the ground. As shown, the pile 130 may be larger than the post 140 and may be precast, pre-stressed or post-stressed, reinforced concrete and may have the same shape as examples described, previously, or additional shapes. In one example, a paddle shaped pile 130 is attached to a post 140 having a smaller width than the pile 130. The post 140 may be precast, pre-stressed or post-stressed reinforced concrete, also, for example. For example, the collar 120 may be sized larger or smaller depending on the amount of anchoring needed to keep the pile 130 and post 140 in fixed position. In one example, the height of the collar 120 extends above weldments made to joint the post 140 to the pile 130 and the seam or joint between the collar 120 and post 140 may be sealed, such as with a sealant 169, to protect the weldments from the elements, for example. In another example, the collar 120 may be poured up to grade or even above grade, such that the collar 120 serves as a load bearing surface for the weight of a panel installed between two posts. For example, the collar may be elongated in a direction under the panel. In one example, the collar may be poured such that the collar of one post continues to the next post, providing a continuous footing below a sound barrier wall, and collar provides a load bearing support for the sound wall. For example, reinforcing members may be laid in a trench formed for pouring of the collar.

This detailed description provides examples including features and elements of the claims for the purpose of enabling a person having ordinary skill in the art to make and use the inventions recited in the claims. However, these examples are not intended to limit the scope of the claims, directly. Instead, the examples provide features and elements of the claims that, having been disclosed in these descriptions, claims and drawings, may be altered and combined in ways that are known in the art.

What is claimed is:

1. A wall for a fluidizable soil comprises:

an above-ground wall panel, having a panel width, the width of the panel extending from a first side to a second side, opposite of the first side, and a panel height extending above the fluidizable soil between the first side and the second side;

a first retaining member of a pair of retaining members being disposed on the first side of the panel and having a retaining portion engaging at least a portion of the first side; and a second retaining member of the pair of retaining members being disposed on the second side of the panel and having a retaining portion engaging at least a portion of the second side, wherein each of the pair of retaining members has a paddle shape comprised of a paddle-shaped end portion having a length, a width and a thickness, the length being greater than the width, and the width being greater than the thickness of the paddle-shaped end, the paddle-shaped end portion extending from the retaining portion for insertion of the length of the paddle-shaped end portion into the fluidizable soil, the width of the paddle-shaped end portion being greater than a corresponding width of the retaining portion, and the width of the paddle-shaped end portion extends a distance beyond the retaining portion and below at least a portion of the panel width of the wall panel;

an inlet port;

at least one channel extending from the inlet port and through at least a portion of the paddle-shaped end portion; and at least one exit port in the paddle-shaped end portion;

wherein the at least one channel fluidically couples the inlet port to the at least one exit port, and the inlet port, the at least one channel and the at least one exit port are arranged and configured such that a fluid injected at a pressure and a flow rate into the inlet port, through the at least one channel and out of the at least one exit port, fluidizes the fluidizable soil below each of the retaining members, reducing the bearing capacity of the fluidizable soil, when the fluid is being injected, such that the retaining member penetrates into the fluidizable soil, and the fluidizable soil is consolidated around the paddle-shaped end portion, when the fluid ceases to be injected, such that the fluidizable soil supports the retaining member and the wall panel supported by the retaining member, such that the first retaining portion, the second retaining portion, and the wall panel are supported by the paddle-shaped end portions of each of the retaining portions when the paddle-shaped end portion is inserted into the soil by fluidizing the fluidizable soil, without setting any portion of the wall in a grout and waiting for the grout to cure.

2. The wall of claim 1, wherein the pair of retaining members are pre-stressed concrete.

3. The wall of claim 1, wherein the pair of retaining members are post-stressed concrete.

4. The wall of claim 1, wherein the pair of retaining members are each comprised of a separate post and pile, and the separate post and pile are joined together after the pile is inserted into the ground.

5. The wall of claim 4, further comprising a collar, wherein the collar is poured in place, after the post and pile are joined together.

6. The wall of claim 5, wherein the collar is below grade and is covered by soil.

7. A method of installing the wall of claim 1, comprising:

selecting a location with a fluidizable soil;

positioning the paddle-shaped end portion of one of the pair of retaining members over the fluidizable soil;

injecting a fluid through the inlet port, the at least one channel and the at least one exit port at a pressure and a flow rate that fluidizes the soil, reducing the bearing capacity of the soil, such that the one of the pair of retaining members penetrates into the soil, and the soil is consolidated around the paddle-shaped end portion;

positioning the paddle-shaped end portion of the other of the pair of retaining members at a distance from the one of the pair of retaining members and over the fluidizable soil; and injecting a fluid through the inlet port, the at least one channel and the at least one exit port at a pressure and a flow rate that fluidizes the soil, reducing the bearing capacity of the soil, such that the other of the pair of retaining members penetrates into the soil, and the soil is consolidated around the paddle-shaped end portion, wherein the distance from the one of the pair of retaining members is selected such that the panel width is greater than a gap distance between the pair of retaining members; and lowering the panel between the pair of retaining members such that the retaining portion of the first retaining member engages at least the portion of the first side of the panel, and the retaining portion of the second retaining member engages at least the portion of the second side of the panel, such that the first retaining portion, the second retaining portion, and the wall panel are supported by the paddle-shaped end portions of each of the retaining portions when the paddle-shaped end portion is inserted into the soil by fluidizing the fluidizable soil, without setting any portion of the wall in a grout and waiting for the grout to cure.

8. The method of claim 7, further comprising selecting the width of the paddle-shaped end portion, such that the consolidated soil, consolidated by fluidizing the soil, firmly supports the pair of retaining members and is sufficient to hold the panel without grouting the soil.

9. The method of claim 8, the fluid comprises water and air.

10. The method of claim 8, wherein the step of fluidizing proceeds as a result of the weight of the retaining member.

11. The method of claim 7, further comprising preconditioning the soil prior to the steps of positioning.

12. The method of claim 11, wherein the step of preconditioning comprises drilling through any obstructions.

13. The method of claim 12, wherein the soil is retaining in the pre-conditioned column of soil.

14. The method of claim 12, wherein at least a portion of original soil in the pre-conditioned column of soil is removed and replaced with a fluidizable soil in the pre-conditioned column of soil.

15. The method of claim 14, wherein the soils comprises a rocky soil, and some or all of the rocky soil is removed, forming a hole, and the hole is filled with a fluidizable soil.

16. The method of claim 15, wherein the fluidizable soil is a wet sand.

17. The method of claim 7, further comprising joining the retaining portion to the paddle-shaped end portion of each of the pair of retaining members after the step of positioning and before the step of lowering.

18. The method of claim 17, wherein the step of joining comprises welding.

19. The method of claim 17, further comprising pouring a collar around a joint between the paddle-shaped end portion and the retaining portion.

20. The method of claim 19, wherein a size of the collar anchors the wall when buried below grade.

* * * * *